US007972481B2

(12) United States Patent
Amonarriz Azcolain et al.

(10) Patent No.: US 7,972,481 B2
(45) Date of Patent: Jul. 5, 2011

(54) SCRAPING APPARATUS FOR THE PAPER INDUSTRY

(76) Inventors: Jose Joaquin Amonarriz Azcolain, Tolosa (ES); Jose Miguel Echeberria Goicoechea, Tolosa (ES)

( * ) Notice: Subject to any disclaimer, the term of this patent is extended or adjusted under 35 U.S.C. 154(b) by 120 days.

(21) Appl. No.: 12/524,046

(22) PCT Filed: Feb. 27, 2008

(86) PCT No.: PCT/ES2008/000112
§ 371 (c)(1),
(2), (4) Date: Jul. 22, 2009

(87) PCT Pub. No.: WO2009/007473
PCT Pub. Date: Jan. 15, 2009

(65) Prior Publication Data

US 2010/0018661 A1 Jan. 28, 2010

(30) Foreign Application Priority Data

Jul. 11, 2007 (ES) ..... 200701941

(51) Int. Cl.
*D21G 3/00* (2006.01)

(52) U.S. Cl. ..... 162/272

(58) Field of Classification Search ..... 162/272, 162/281; 118/126, 410, 413
See application file for complete search history.

(56) References Cited

U.S. PATENT DOCUMENTS

| | | | | |
|---|---|---|---|---|
| 3,882,817 | A * | 5/1975 | Zink | 118/126 |
| 4,860,686 | A * | 8/1989 | Kato et al. | 118/410 |
| 5,085,168 | A * | 2/1992 | Sollinger | 118/126 |
| 5,138,970 | A * | 8/1992 | Sollinger | 118/126 |
| 5,980,692 | A * | 11/1999 | Goodnow et al. | 162/281 |
| 6,524,444 | B2 * | 2/2003 | Brauns et al. | 162/281 |

FOREIGN PATENT DOCUMENTS

| | | | |
|---|---|---|---|
| DE | 3618772 | A | 12/1987 |
| EP | 1042554 | | 10/2000 |
| EP | 1381733 | | 1/2004 |
| EP | 1541761 | Y | 6/2005 |
| EP | 1734182 | | 12/2006 |
| EP | 1746206 | | 1/2007 |
| ES | 2282411 | | 1/2004 |
| GB | 964357 | A | 7/1964 |
| WO | 2006091427 | A | 8/2006 |

* cited by examiner

*Primary Examiner* — Mark Halpern
(74) *Attorney, Agent, or Firm* — Lucas & Meercanti, LLP

(57) ABSTRACT

Scraping apparatus for the paper industry, of the type which consists of a scraping blade (l), a support (s) for the scraping blade (l) with a pivot swivel pin (e) with respect to a tray (4), said tray being supported (4) on the frame (b) of the apparatus, characterized because magnetic means are used to exert magnetic forces between the tray (4) or from the fixed element to it and the frame (b), and there are means of action on said magnetic means to activate/deactivate the magnetic forces between the tray (4) and the frame (b).

The magnetic means consist of at least one zone (z) of ferromagnetic material and several permanent magnets or electromagnets (1) placed on the tray (4)-frame (b) in a conjugate/corresponding manner.

11 Claims, 9 Drawing Sheets

SCRAPING APPARATUS FOR THE PAPER INDUSTRY

This application is a 371 of PCT/ES2008/000112 filed Feb. 27, 2008, which in turn claims the priority of ES P200701941 filed Jul. 11, 2007, the priority of both applications is hereby claimed and both applications are incorporated by reference herein.

The object of the invention is a scraping apparatus for the paper industry, of the type which consists of a scraping blade, a support for the scraping blade with a pivot swivel pin with respect to a tray, said tray being supported on the frame of the apparatus.

In particular, the object of the invention refers to solutions of extraction, insertion and anchoring of a blade support on the frame of a doctor, in which access is limited to the sides of said doctor.

BACKGROUND OF THE INVENTION

Current state of the art scraping apparatus of the aforementioned type are already known, among which examples can be cited such as the documents of Patent EP1746206, EP1734182, EP1381733, EP1042554 and WO2006091427.

The known solutions present limitations and/or defects; in them, when the extraction is carried out laterally and with no movement in another direction, there is no reliable system which allows the elimination of clearances in the zones which are far from the sides of the doctor.

Because of this, the clearances in the guide cannot be elevated and consequently:

$a_1$) the operations of insertion and extraction of the blade support may have their difficulties.

$a_2$) as the guide becomes dirtier, the operation of insertion and extraction becomes more difficult to realize (and if the initial clearance is not elevated, this problem is accentuated.

b) The positioning of the blade may not be repetitive.

c) When unexpected forces appear in the process, for example, impact due to the passing of a sheet of paper) the system could lose the preload and vibrations could occur due to the clearances.

d) In order to eliminate said clearance, in previous solutions, a mechanical blocking solution was used, installed inside the slot, a mechanical solution which:

$d_1$) may become blocked by dirt, making extraction of the blade support difficult or impossible.

$d_2$) uses a spline which undergoes significant deformations in each extraction and insertion operation, and could therefore have fatigue problems.

To solve these limitations and/or defects, known technology utilizes:

- elevated clearances
- anchoring in different longitudinal positions of the blade support to avoid the problems caused by elevated clearances.
- fastening systems whose functionality is not affected by dirt.

The scraping apparatus of the present invention provides a solution to these limitations and/or defects with unique technology which uses magnetic forces to anchor the blade support to the frame. The use of magnetic forces allows the fixing force to be deactivated or activated with a simple operation. Moreover, said operation of activation or deactivation can be carried out at a distance. Thus, from the side of the doctor, the force produced along the entire length of the doctor can be activated or deactivated.

The magnetic anchor makes it possible for the system to use elevated clearances in the guidance system, which results in greater ease of extraction and insertion, as once the system is set up, we eliminate said clearance with magnetic forces. Moreover, in certain specific embodiments, a system can be made whose positioning is repetitive.

SUMMARY OF THE INVENTION

The scraping apparatus for the paper industry which is the object of the invention, being the type which consists of a scraping blade, a support for the scraping blade with a pivot swivel pin with respect to a tray, said tray being supported on the frame of the apparatus, is characterized because:

a) there are magnetic means which exert magnetic forces between the tray or from fixed element to it and the frame, and b) means of action on the magnetic means to activate/deactivate the magnetic forces between the tray and the frame.

It is also characterized because the magnetic means consist of at least one zone of ferromagnetic material and several permanent magnets or electromagnets placed on the tray-frame in a conjugate/corresponding manner.

In the scraping apparatus which is the object of the invention, the process of mounting, dismounting and anchoring of the blade support on the doctor will be carried out in a similar manner, whichever the specific embodiments involved may be:

In the operation of extraction of a blade support, the magnetic force of attraction of the fixing system is deactivated; thus, the blade support and the doctor are then joined by very simple fastening elements, and with great clearance, allowing the blade support to come out of the doctor.

In the operation of insertion of a blade support, the following occurs in succession: the blade support is inserted into the doctor, the blade support is positioned on the doctor, and the magnetic force of attraction is activated.

The advantages of the scraping apparatus for the paper industry, according to the invention, are evident in its structure, components, and arrangement:

- Once the blade support is inserted, it allows the anchoring of the same in any position of the blade support, only acting on the side of the same (in the case of a permanent magnet) or even from a control cabinet (in the case of an electromagnet).
- The anchoring force can be activated and deactivated in a simple manner.
- The system can be dimensioned to exert the appropriate anchoring force. With only simple modifications, said force can be varied after being built (through the modification of the work intensity in an actuator based on an electromagnet or through the modification of the distance between magnets on an actuator based on permanent magnets.).
- The process of insertion and extraction is an easily executed operation.
- Allows the use of elevated clearances for the operation of insertion and extraction, so that the dirt of the guide becomes a secondary factor. Moreover, when no extraction or insertion operation is being carried out, said clearance does not exist.
- once the magnetic force is activated, the position of the blade is repeated.

BRIEF DESCRIPTION OF THE DRAWINGS

To better understand the object of this invention, a preferable form of practical embodiment is shown in the diagrams, subject to minor changes which do not alter it fundamentally.

DETAILED DESCRIPTION OF THE INVENTION

The following is a description of an example of practical, non-limited embodiment of this invention.

The object of the invention is a scraping apparatus for the paper industry of the type which consists of a scraping blade (l), support (s) for the scraping blade (l) with a pivot swivel pin (e) with respect to a tray (4), said tray being supported (4) on the frame (b) of the apparatus.

According to the invention, there are:

a) magnetic means to exert magnetic force between the tray (4) or from fixed element to it and the frame, and b) means for action on the magnetic means to activate/deactivate the magnetic forces between the tray (4) and the frame (b).

In any solution, the anchoring of the blade support on the doctor is realized solely by magnetic forces.

The system guidance operates by using elements (5) whose only function is that of guiding the blade support at the moment the magnetic force is deactivated, and that of allowing the lateral extraction of the blade support.

Figure 1:
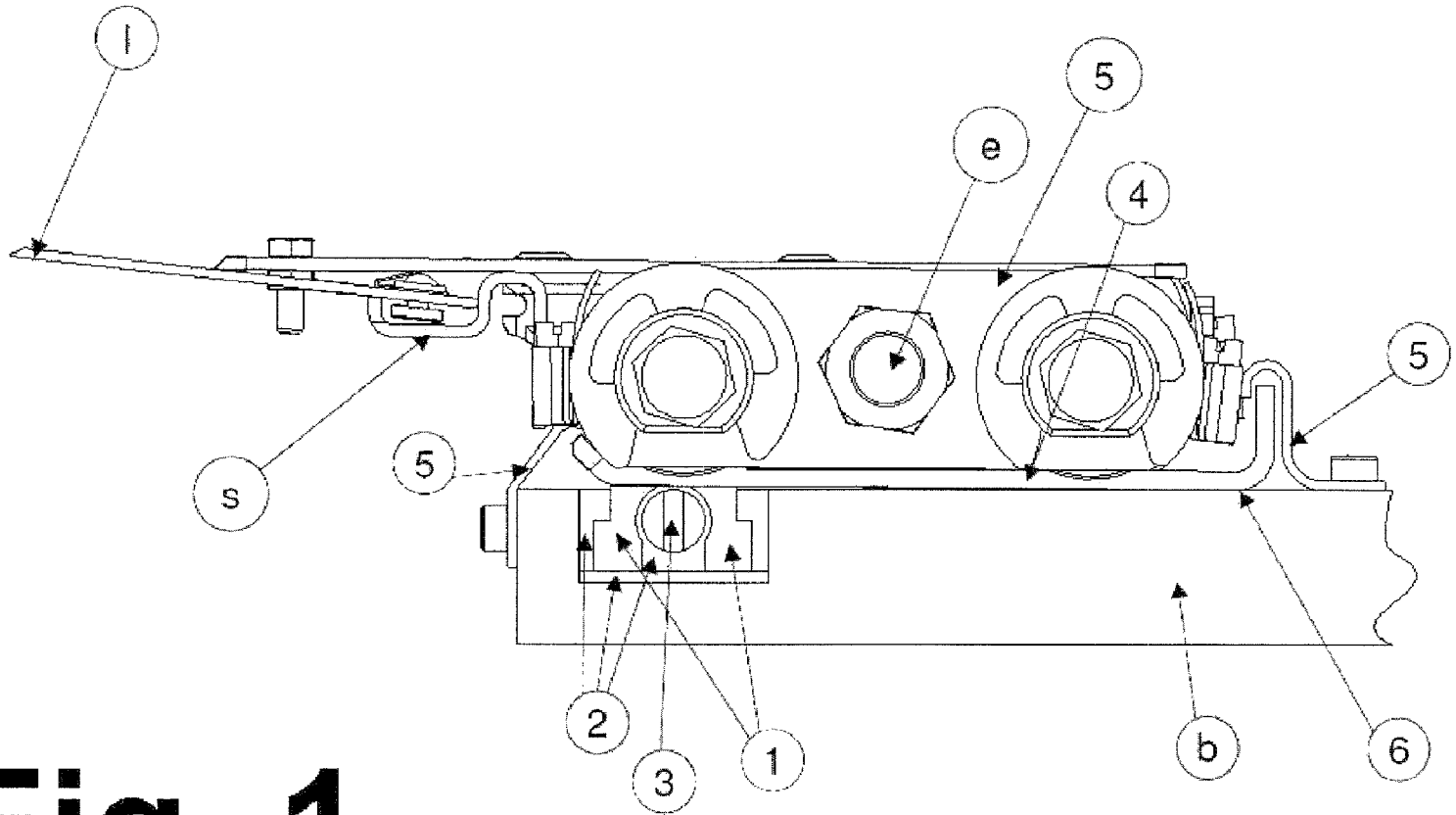
FIG. 1 is an elevation view of a first embodiment of a scraping apparatus according to the invention with a magnetic actuator placed on the outer front of the scraping apparatus.

According to the embodiment shown in FIG. 1, the function of the guidance elements (5) for extraction is limited exclusively to fastening the blade support when carrying out the operation of extraction or of insertion of the blade support on the doctor. The anchoring of the blade support to the doctor is done through the force of attraction of the magnetic actuator unit (1, 2 and 3) on the base (4) of the blade support. When the stress of the process is being made on the tip (7) of the blade (l), the moment generated by said stress is supported by the magnetic actuator unit (1, 2 and 3), and the bearance (6) at the end of the support(s) of the blade support.

The magnetic actuator unit includes at least one permanent or electromagnetic magnet (1) permeable material (2) and non-permeable material (3) installed in the frame (b) and said permanent magnet/electromagnet acting or not acting (1) on a zone of ferromagnetic material (z) installed on the blade support (s). Hereinafter we will identify this composition as magnetic means unit (1), (2), (3).

Figure 2:
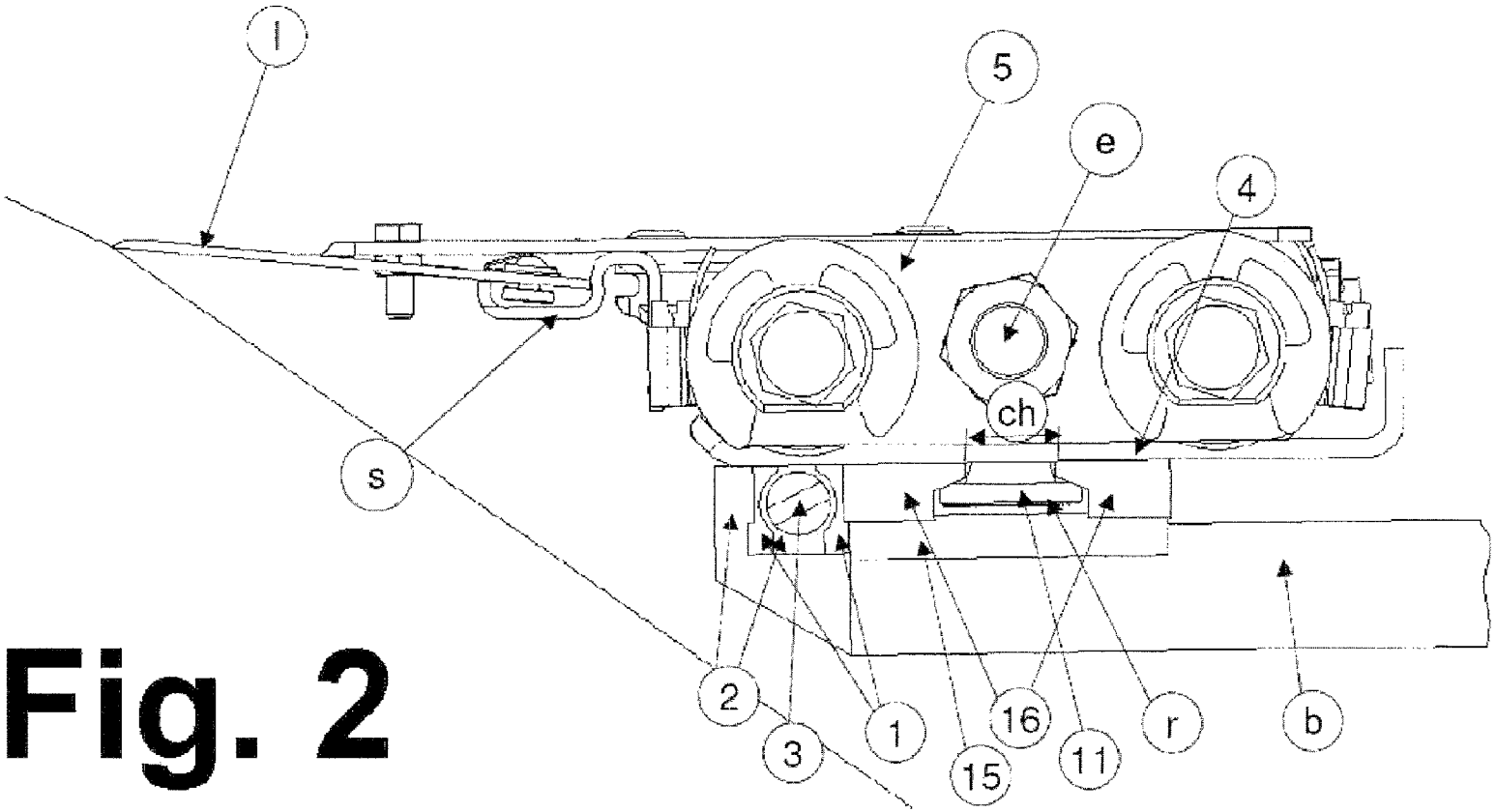
FIG. 2 is an elevation view of a second embodiment of a scraping apparatus according to the invention with a magnetic actuator placed on the outer front of the scraping apparatus.

The embodiment shown in FIG. 2 is similar to that shown in FIG. 1, but including one guidance element (11) in a longitudinal slot (r); thus, there is:

a) in the frame, (b) a longitudinal slot (r) with an opening (ch) and b) a guidance element (11) joined to the tray (4) by a body (15) of walls (16) which are conjugated with the walls of the opening (ch), the guidance element (11) being fitted with clearance into the longitudinal slot (r) so that with the means of action in the situation of deactivating the magnetic force the tray (4) can pivot lightly with respect to the frame (b) and/or can move longitudinally on it.

The process of this second solution is similar to the process of the aforementioned first solution, the main difference with respect to it lies in that if the magnetic actuator (1) cannot support the stresses generated in the process the guidance element (11) will be able to absorb said stresses.

Figure 3:
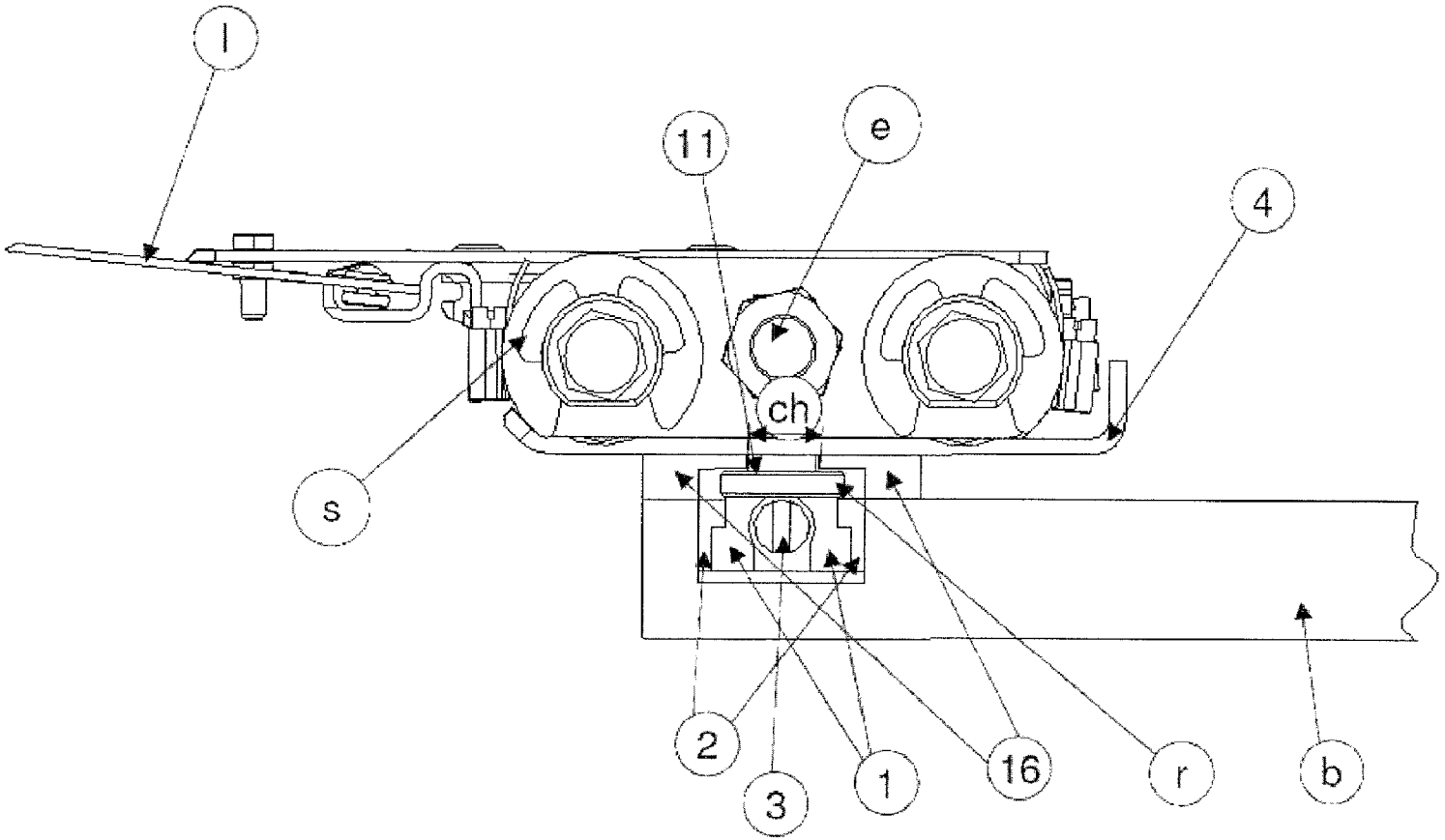
FIG. 3 is an elevation view of a third embodiment of a scraping apparatus according to the invention with the magnetic actuator positioned inside, under the guide button.

This second solution can also be implemented, as shown in FIG. 3, including the magnetic means unit (1), (2), (3) under the element-guide (11). This solution simplifies the manufacture of the apparatus, although it requires more powerful magnets to support the same load.

Figure 4A:
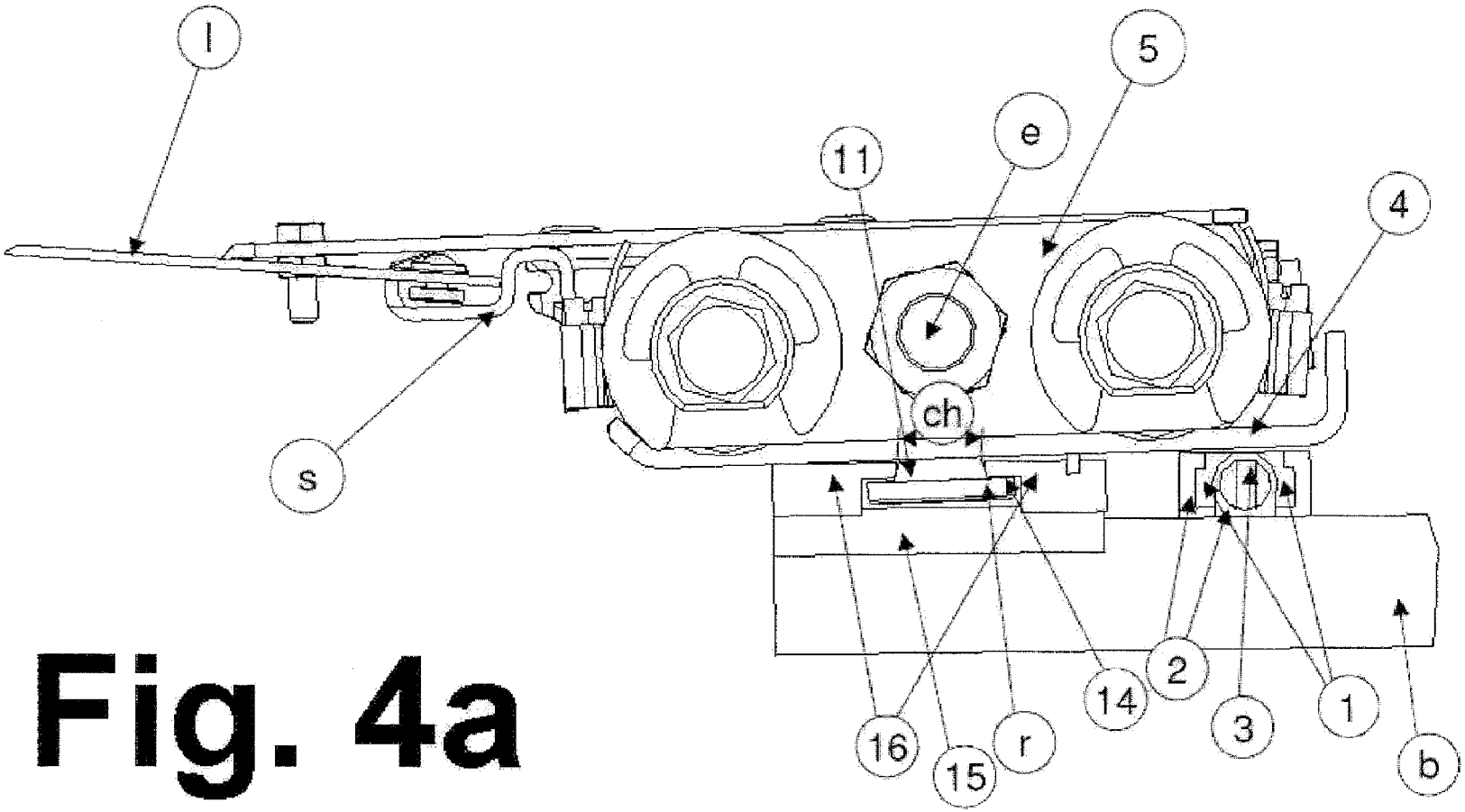
FIG. 4*a* is an elevation view of a fourth embodiment of a scraping apparatus according to the invention with a magnetic actuator positioned on an outer rear when the magnet is not actuating.
Figure 4B:
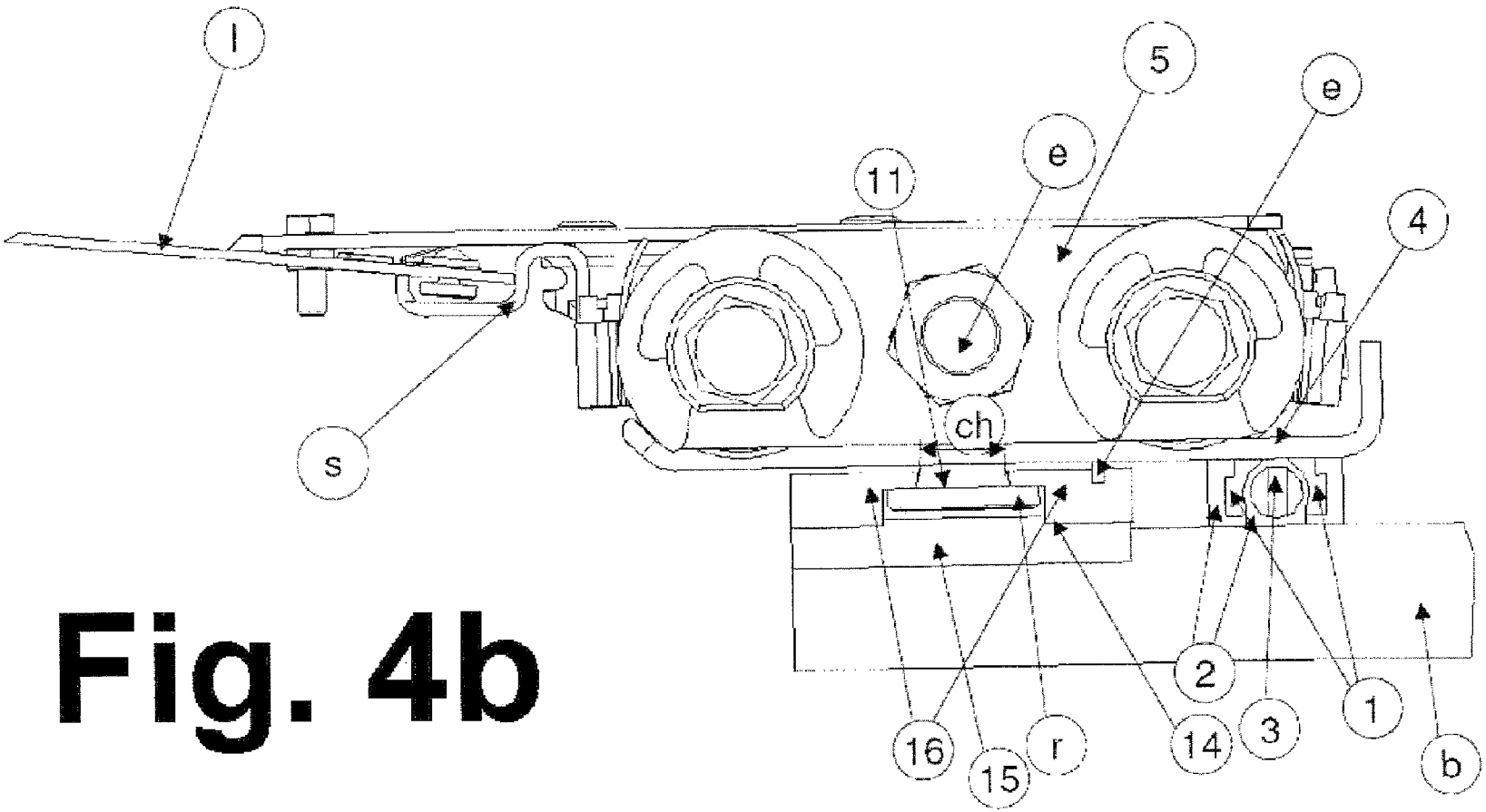
FIG. 4*b* illustrates an alternative elevation view of the fourth embodiment of when the magnet is actuating.

The embodiment shown in FIGS. 4*a* and 4*b* is similar to that shown in FIG. 2, with the difference that it has the magnetic means unit (1), (2), (3) on the opposite side (in front in FIG. 2 and in rear in FIG. 4).

Figure 5:
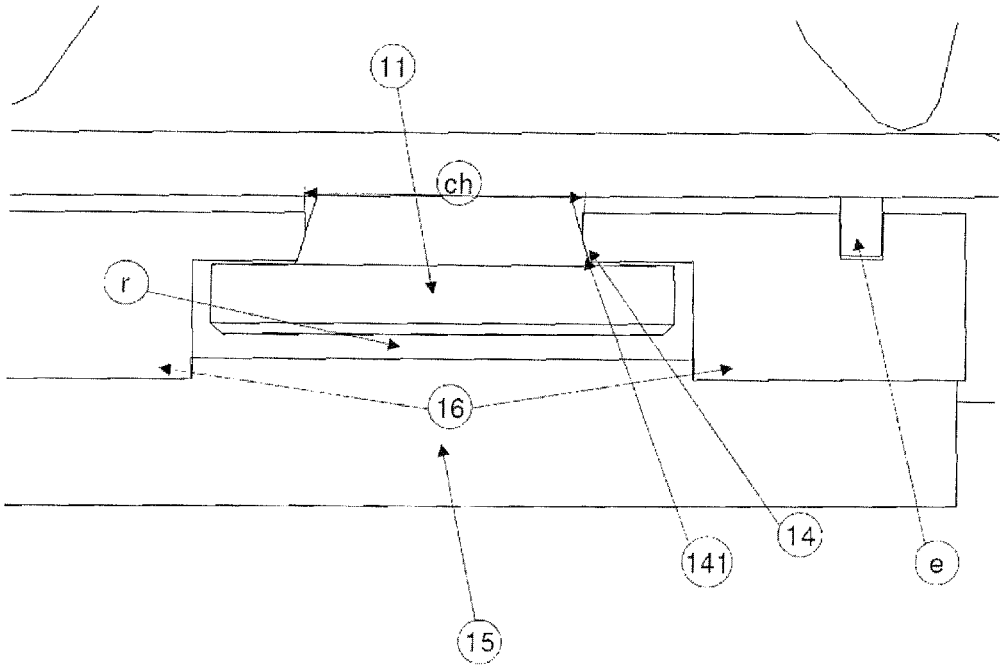
FIG. 5 is an enlarged detail view corresponding to FIG. 4.

The guidance element (11) defines an inner position (15) with walls (16) conjugated with the walls of a defined opening (ch) in a supplementary support element (14)—see detail, FIG. 5—.

In this solution, the magnetic anchoring is used to fix the blade support (s) against the frame (b) permanently. In this case the effort which the magnetic anchor must make (1), (2), (3) is very small, and when said anchoring is done, the position of the blade support (5) with respect to the frame (b) is repetitive and the clearances which exist at the moment of mounting are totally eliminated. The mounting clearance is removed on activating the magnetic actuator (1), (2), (3); then the blade support is supported on the supplementary element (14), and on the conical face of the button (11). The force of the process in this case goes in favour of the magnet (1) and therefore, the magnetic system is less voluminous than in previously described solutions.

This embodiment has two different states once the blade support (5) has been inserted in the doctor:

1.—Actuator inactive (FIG. 4*a*) In this case, the force exerted by the magnetic actuator is negligible, and the blade support is supported on the supplementary element (14) and on the guidance elements (11). The clearance (r) which exists in this situation is elevated, as the supplementary support element (14) can only not restrict left to right movements as well as the turning on that same point.

2.—Actuator actuating (FIG. 4*b*). The magnetic unit (1, 2 and 3) creates a force of attraction (downwards in the figure) on the support of the blade support (4). Said force of attraction causes, when the system turns on the bearance (e), the guidance element (11) of the blade support part moves upwards until reaching the stop with the guide (141) of the support element (14). The fact that the guidance element (11) has a conical shape (15), (16) causes this element to be placed on a small chamfer (ch) which is done on a guide (141), so that the position of balance will be single and therefore, the positioning of the blade support is made repetitive.

Figure 8:
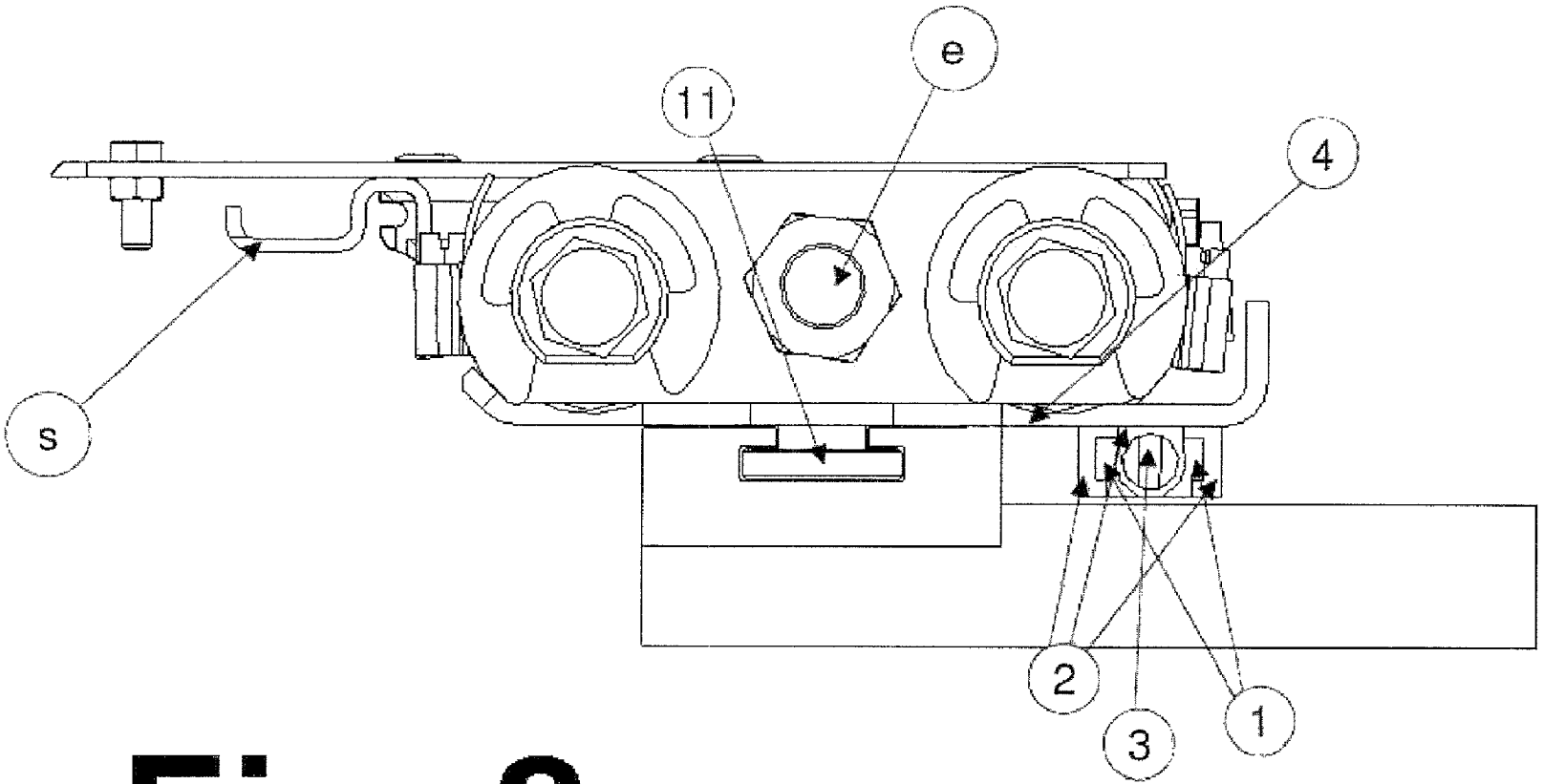
FIG. 8 is an alternative embodiment of FIG. 4.

Although in the previous figures the actuator has been anchored to the frame of the doctor, the operation of the apparatus is equivalent when the actuator is anchored the blade support (5) itself and facing the frame (b). FIG. 8 shows one of the options of said solution.

To eliminate the clearances in this example of embodiment the procedure is as follows:

When the magnetic means (1), (2), (3) do not actuate, the position of the blade support with respect to the guide is any intermediate position.

The existing path between both end positions is the clearance (r) that the system will have at the moment in which the extraction or insertion of the blade support of the frame of the doctor is carried out. The greater the existing clearance (r), the easier operations of extraction and insertion will be to carry out. The action of the magnetic means (1), (2), (3) allows the elimination of said clearances (r) once the operations of extraction and insertion have been carried out. When no operation of extraction or of insertion of the blade support in the doctor is being carried out, the clearances (r) are no longer necessary, and can only provide negative aspects in the operation of the apparatus.

Figure 7:
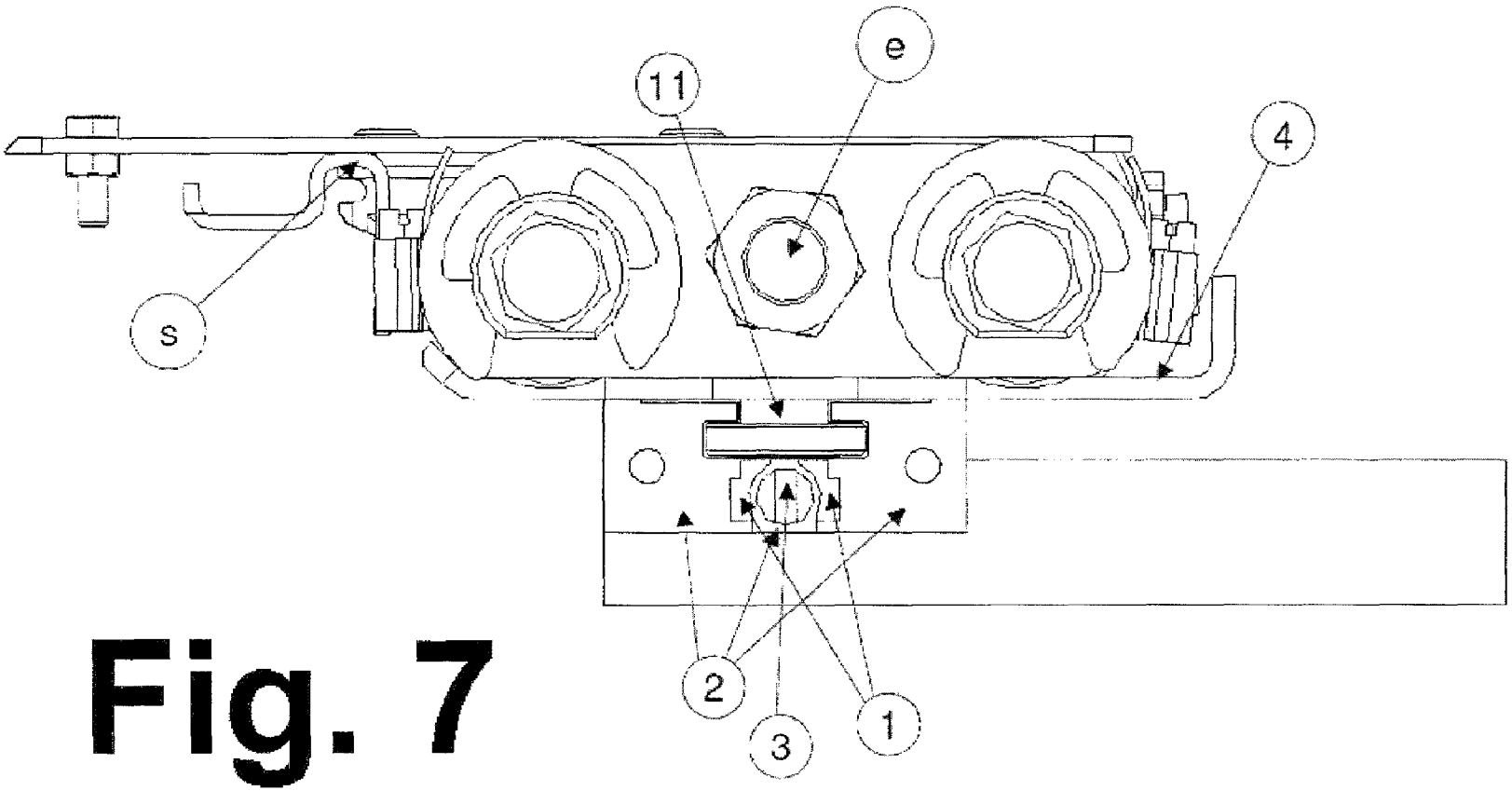
FIG. 7 is an alternative embodiment of FIG. 3.

The solution can also be implemented as shown in FIG. 7, including the magnetic means unit (1), (2), (3) under the guide element (11). This solution simplifies the manufacture of the apparatus, although it requires stronger magnets to support the same load.

Figure 6:
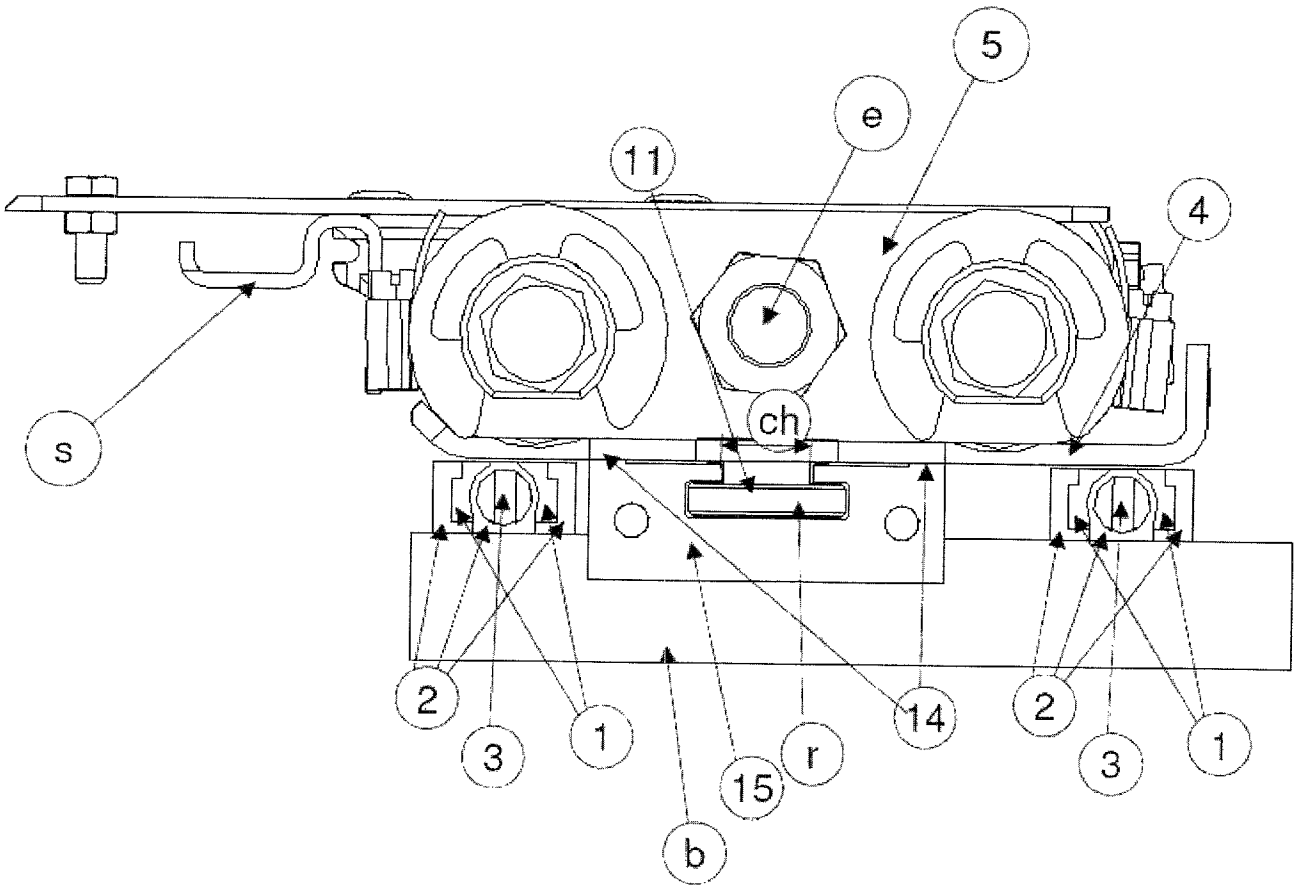
FIG. 6 is an elevation view of a fifth embodiment of a scraping apparatus according to the invention, which includes two magnetic actuators, one positioned on the front and another positioned on the rear.

The embodiment shown in FIG. 6 is similar to that shown in FIG. 4 with the difference that there is more than one magnetic means unit (1), (2), (3). Specifically, there is at least one magnetic means unit (1), (2), (3) on each side of the pivot swivel pin (e).

In the example of embodiment which includes more than one magnetic means unit, the blade support is supported throughout the entire base (4) as it is acting on both sides of the blade support.

Included in the object of the invention are all other alternative embodiments which do not essentially alter, change or modify the proposal. For example, among others, it is included in the object of the invention that:

the guidance element (11) is positioned centrally with respect to the pivot swivel pin (e)—FIGS. 2, 3, 4, 6, 7 and 8— the magnetic means (1), (2), (3) are positioned with respect to the pivot swivel pin (e) on one side, nearer to the blade (l)—FIGS. 1, 2—on the other, further from the blade (l)—FIGS. 4, 8—on both sides. FIG. 6—or even centrally aligned with respect to the pivot swivel pin (e)—FIGS. 3, 7—.

The anchoring system can be positioned in different ways, obtaining different features. These include, among other possibilities:

To use more than one magnetic means (1)—FIG. 6—

To use some means (1) in front of the guidance element (11)—FIG. 1—

To use some magnetic means (1), (2), (3) under the guidance element (11)—FIG. 7—

To use some magnetic means (1), (2), (3) behind the guidance element (11)

The magnetic means (1), (2), (3) have both the frame (b) and the blade support (4) or the opposite: The magnet/electromagnet unit (1)/permeable material (2)/non-permeable material (3) on the blade support (4) and the ferromagnetic material zone (z) on the frame (b).

In any of the solutions the magnetic means (1), (2), (3) can be anchored to either the frame (b) or to the base of the blade support (s).

The means of operation are mechanical/manual and in the unit (1) the magnetic means are magnets so that the flow of the magnets is directed, or not directed, (1) toward the zone (z) of ferromagnetic material.

The means of operation are means of activation/deactivation of current and the magnetic means (1), (2), (3) are electromagnets so that they are activated/deactivated by electric connection/disconnection even by remote control.

The same function can be carried out with two types of different magnetic means (1), (2), (3): the electromagnetic actuator and the actuator with permanent magnet.

The pivot swivel pin (e) is bearing type, presenting, for example, tubular configuration.

The invention claimed is:

1. A scraping apparatus for a paper industry, comprising:

a frame having a longitudinal opening;

a tray supported on the frame;

a scraping blade;

a support for the scraping blade having a pivot swivel pin so that the scraping blade is pivotable with respect to a the tray;

magnetic means for exerting magnetic forces for fixing the tray to the frame, the magnetic means fixed to the frame;

means of action to activate/deactivate the magnetic forces for fixing the tray to the frame; and a guidance element fixed to the tray and extending into the longitudinal slot so that when the means of action deactivate the magnetic forces, the tray can pivot with respect to the frame and/or can move longitudinally on the frame.

2. The apparatus of claim 1, wherein the magnetic means consist of comprise ferromagnetic material and a plurality of permanent magnets or electromagnets placed on the tray in a conjugate/corresponding manner.

3. The apparatus of claim 1, wherein the guidance element is positioned on the tray centrally with respect to the pivot swivel pin.

4. The apparatus of claim 3, wherein the pivot swivel pin and the magnetic means are positioned on one side of the scraping apparatus and the scraping blade is on another side of the scraping apparatus.

5. The apparatus of claim 3, wherein the pivot swivel pin and the magnetic means and the scraping blade are positioned on a same side of the scraping apparatus.

6. The apparatus of claim 3, wherein the magnetic means is positioned centrally with respect to the pivot swivel pin.

7. The apparatus of claim 1, wherein the magnetic means and the scraping blade are positioned on a same side with respect to the pivot swivel pin, and at least one clamp is fixed to the frame which, at least on one side with respect to the pivot swivel pin seats in guidance with a lap of the tray.

8. The apparatus of claim 1, wherein the means of action are manually capable of directing the flow of the magnets toward the ferromagnetic zone.

9. The apparatus of claim 1, wherein the means of action is an electrical current of electromagnets, which activates and deactivates the magnetic forces fixing the tray to the frame.

10. The apparatus of claim 1, wherein the pivot swivel pin is a rolling element.

11. The apparatus of claim 10, wherein the rolling element is a tube or a bearing.

* * * * *